United States Patent [19]

Urquhart et al.

[11] Patent Number: 4,971,221

[45] Date of Patent: Nov. 20, 1990

[54] DRUG DISPENSER HAVING MEANS FOR DETECTING DISPENSING EVENTS

[75] Inventors: John Urquhart, Palo Alto; Richard G. Hamilton, Fremont, both of Calif.

[73] Assignee: Aprex Corporation, Fremont, Calif.

[21] Appl. No.: 275,814

[22] Filed: Nov. 23, 1988

[51] Int. Cl.[5] ..... B65D 83/04

[52] U.S. Cl. ..... 221/2; 221/25

[58] Field of Search ..... 221/2, 3, 5, 7, 25

[56] References Cited

U.S. PATENT DOCUMENTS

| | | | |
|---|---|---|---|
| 3,369,697 | 2/1968 | Glucksman et al. . | |
| 3,395,829 | 8/1968 | Cogdell et al. . | |
| 3,651,984 | 3/1972 | Redenbach . | |
| 3,722,739 | 3/1973 | Blumberg . | |
| 3,762,601 | 10/1973 | McLaughlin . | |
| 3,815,780 | 6/1974 | Bauer . | |
| 3,837,139 | 9/1974 | Roseberg | 221/7 X |
| 3,911,856 | 10/1975 | Ewing . | |
| 3,917,045 | 11/1975 | Williams . | |
| 3,968,900 | 7/1976 | Stambuk . | |
| 3,985,264 | 10/1976 | Shaw et al. | 221/7 |
| 3,998,356 | 12/1976 | Cristensen . | |
| 4,034,757 | 7/1977 | Glover . | |
| 4,117,952 | 10/1978 | Grimes | 221/5 |
| 4,163,507 | 8/1979 | Bell . | |
| 4,207,992 | 7/1980 | Brown . | |
| 4,223,801 | 9/1980 | Carlson . | |
| 4,258,354 | 3/1981 | Carmon et al. . | |
| 4,275,384 | 6/1981 | Hicks et al. . | |
| 4,360,125 | 11/1982 | Martindale et al. . | |
| 4,361,408 | 11/1982 | Wirtschafter . | |
| 4,367,955 | 1/1983 | Ballew . | |
| 4,382,688 | 5/1983 | Machamer . | |
| 4,419,016 | 12/1983 | Zoltan . | |
| 4,448,541 | 5/1984 | Wirtschafter . | |
| 4,473,884 | 9/1984 | Behl . | |
| 4,483,626 | 11/1984 | Nobel . | |
| 4,490,711 | 12/1984 | Johnston . | |
| 4,504,153 | 3/1985 | Schollmeyer et al. . | |
| 4,526,474 | 7/1985 | Simon . | |
| 4,573,606 | 3/1986 | Lewis et al. | 221/3 X |
| 4,836,352 | 6/1989 | Tateno et al. | 221/5 X |

*Primary Examiner*—F. J. Bartuska

*Attorney, Agent, or Firm*—Irell & Manella

[57] ABSTRACT

A device for monitoring the dispensing of drugs to a patient is disclosed. This device includes a detector which determines the actual physical delivery of the drug dosage to the patient. This eliminates ambiguities associated with devices in the art which only monitor inferentially the dispensing of the drug dosage to the patient. The detector can include an optical sensor which notes the physical passage of the drug dosage through a dispensing port to the patient.

10 Claims, 6 Drawing Sheets

DRUG DISPENSER HAVING MEANS FOR DETECTING DISPENSING EVENTS

BACKGROUND OF THE INVENTION

1. Field of the Invention

This invention relates to a device for monitoring the dispensing of drugs to a patient. More particularly it relates to such a device which detects in a positive manner the dispensing events.

2. Background Information

A variety of devices and methods have been described for controlling, noting, and keeping track of the dispensing of medicines to patients. These range from a simple nurse's hospital checklist system, to pill containers equipped with alarm clocks and the like and pill containers having timer-controlled latching devices which regulate the patient's access to medication. Some typical examples of these devices include the timed medication dispenser described by Roy J. Machamer in U.S. Pat. No. 4,382,688 which shows a medical dispenser having an electronic reminder to take the medication it contains. In this device the electronic reminder is disabled when the user takes the medication. In U.S. Pat. No. 4,448,541, Jonathan D. Wirtschafter describes a magnetically responsive switch device which is activated when a medication dispenser is opened so as to give an indication of the drug dispensing event. U.S. Pat. No. 4,367,955 of Donald H. Ballew shows a combined timer and container for dispensing medications wherein the container and its lid coact to initiate the timer cycle upon interengagement of the cap and container. U.S. Pat. No. 4,034,757 of Frederick F. Glover shows a fluid dispenser in which there are two switches which both must be activated simultaneously to provide an indication of drug dispensing. In the device a record is created listing dispensing events.

The foregoing patents are merely representative. Other background patents relating to medication dispensers include for example U.S. Pat. Nos. 3,369,697 of Glucksman et al.; 3,395,829 of Cogdell et al.; 3,651,984 of Redenbach; 3,722,739 of Blumberg; 3,762,601 of McLaughlin; 3,815,780 of Bauer; 3,911,856 of Ewing; 3,917,045 of Williams; 3,968,900 of Stambuk; 3,998,356 of Christensen; 4,207,992 of Brown; 4,223,801 of Carlson; 4,258,354 of Carmon et al.; 4,275,384 of Hicks et al.; 4,360,125 of Martindale et al.; 4,361,408 of Wirtschafter; 4,382,688 of Machamer; 4,419,016 of Zoltan; 4,448,541 Wirtschafter; 4,473,884 of Behl; 4,483,626 of Nobel; 4,490,711 of Johnston; 4,504,153 of Schollmeyer et al. and 4,526,474 of Simon.

The devices of the past which noted or kept track of drug dose delivery to the patient generally have sensed the dispensing of the doses inferentially. That is, they have sensed another event associated with the taking of a dose of drug and inferred as the result of the sensing of that event that the drug was in fact dispensed. As can be seen from the brief outlines provided above of some of the prior art patents relating to such devices, the devices may have noted the opening of the drug container via a trip switch or the like. Similarly, prior devices may have noted the inversion of the drug dose container or the like. Yet another approach has been to note the disruption of an electrical conductor as the pill is pushed out of a blister pack, or the like.

In each of these cases with prior art devices there is no direct measurement that the drug dosage has in fact actually physically been delivered to the patient requesting it. This can become a problem if discrepancies are discovered between the number of inferential signals detected and the number of pills actually dispensed. In situations such as in clinical trials or in the dispensing of drugs where the actual dosing pattern is sought, these failings of the devices of the art can add unwanted complexity and at times defeat the purpose of detecting the dose delivery. The present invention provides a device which solves the problems encountered with these devices of the art and gives rise to a more accurate record of the drug dispensing events.

STATEMENT OF THE INVENTION

An improved device for monitoring and detecting the dispensing of doses of drugs to a patient has now been found. This device is characterized by actually sensing the physical passage of the dose of drug from a drug storage area to the patient.

Thus in one aspect this invention provides a device for monitoring the dispensing of drug to a patient which includes the following elements:

A drug dose storage chamber—this chamber is adapted to house a plurality of doses of drug and is coupled in physical communication with an exit passageway. This passageway is sized to permit the passage of a dose of the drug. The drug dose passes through the passageway to the patient. In general, the passageway is similar in cross sectional area to the cross sectional area of the drug dose but large enough to permit the drug dose to easily pass through. The passageway is usually smaller in cross section than the dose storage chamber. The device additionally includes a detector positioned at the passageway and capable of noting the physical passage of the dose of the drug through the passageway and generating a signal in response to the passage so detected. This signal may be recorded, may be used to actuate various devices such as message transmitters, recorders, clocks or the like, or may be used as datum in the calculation of drug dose-related information on a real time, feedback or feedforward basis.

In other aspects, the device may include storage for a plurality of different drugs and may monitor the delivery of them, if desired differentiating among the various members of the plurality.

The methods for noting the passage of the drug dose can include any method which is capable of directly sensing the physical passage of the drug dose through the delivery passageway. These can include optical or infrared detectors which sense variations in such electromagnetic radiations when the drug dose passes through the passageway. Electrical property variations, such as a change in capacitance resulting from the passage of the dose through the passage can also be detected as can variations in ultrasonic signals and the like.

In a preferred embodiment, the device includes a switch in series with the dispensing signaling device so as to turn on the signaling device circuit immediately prior to the dispensing event.

DETAILED DESCRIPTION OF THE INVENTION

Brief Description of the Drawings

The invention will be further described with reference being made to the drawings in which.

DESCRIPTION OF THE PREFERRED EMBODIMENTS

Figure 1:
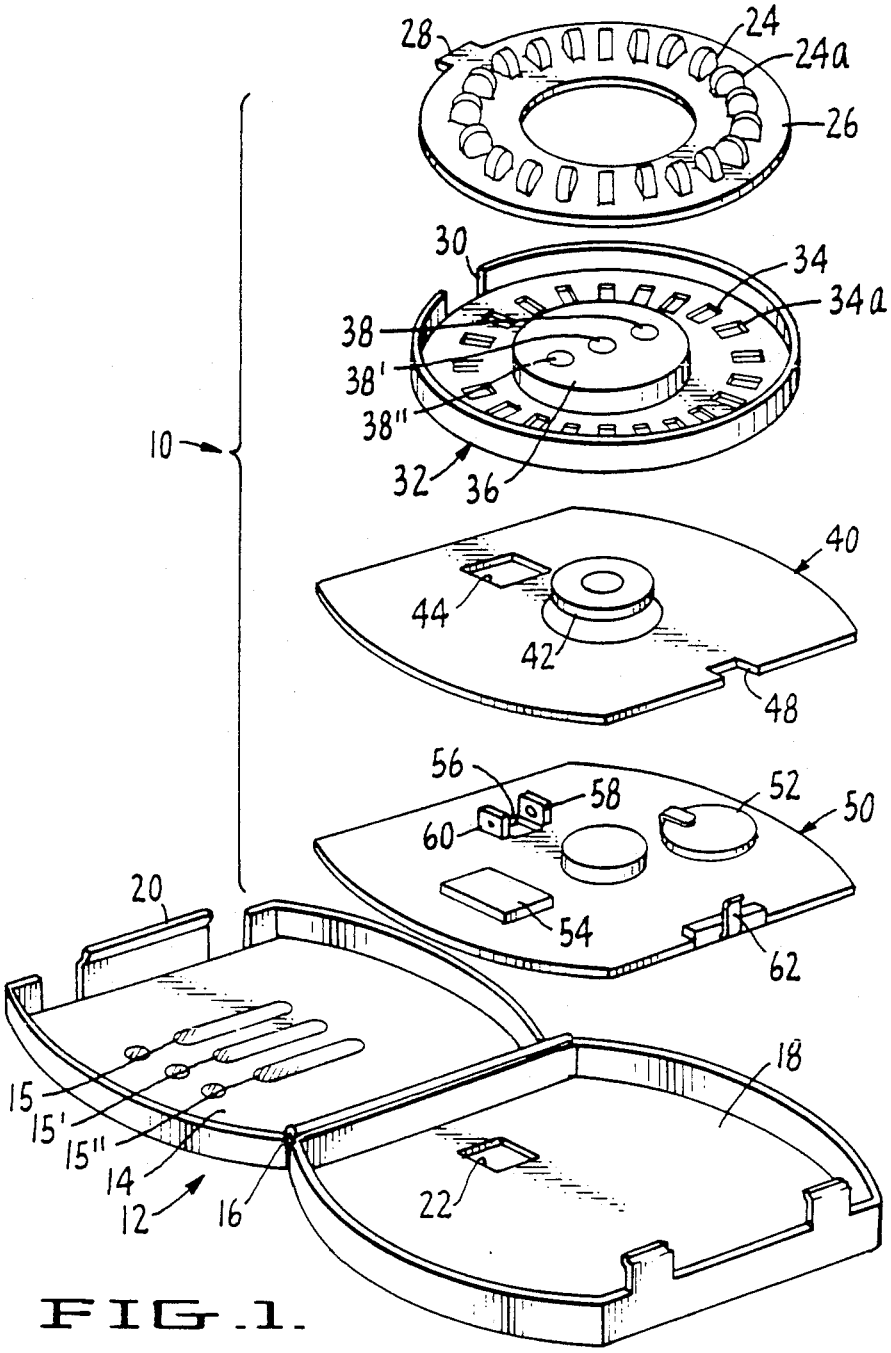
FIG. 1 is an exploded perspective view of one form of device suitable for practicing the present invention.

FIG. 1 illustrates one form of pill dispensing device 10 in accord with this invention. Device 10 includes a case 12 made up of a lid or cover 14 foldably attached via hinge 16 to base 18. Tongue 20 latches the lid to the base when the lid is closed so as to form an enclosed drug storage protection environment. Base 18 has an aperture 22 which defines a drug delivery passage or channel. Contained within case 12 is a supply of pills or tablets. These are illustrated as 24, 24*a*, etc. They are depicted arranged blister packed in a ring configuration on refill card 26. It will be appreciated that card 26 can be dispensed by a pharmacist together with or separate from the remainder of device 10. In the embodiment shown, card 26 has a tab 28 which aligns with and engages a corresponding notch 30 in dispensing wheel 32. In use, the patient or pharmacist latches a refill card 26 into wheel 32. This positive latching and alignment permits each particular pill in the refill card to be aligned with a particular position on the dispensing wheel. Thus, multiple drugs could be included in the refill card and their dispensing individually monitored by monitoring the corresponding positions on the dispensing wheel. This means of monitoring may note individual spaces or may instead monitor groups of spaces, for example, one drug dosage form in spaces 1–7, a second dosage form in spaces 8–14, etc., so as to distinguish among a plurality of drugs in the wheel.

Wheel 32 has a plurality of openings 34, 34*a*, etc., which correspond to positions of pills or tablets 24, 24*a*, etc. Wheel 32 is designed to rotate, and in so doing brings its plurality of openings serially into position to align with opening 22 in the base 18. The center 36 of wheel 32 houses an axle pivot about which the wheel rotates. In the embodiment illustrated, the center includes a plurality (three) of indicators 38, 38' and 38'' the purpose of which will be described below. Wheel 32 rests in intermediate plate 40 which in turn carries axle 42. Axle 42 is designed to permit wheel 32 to rotate about it and generally is designed to permit wheel 32 to be snap fit or otherwise latched over its end. Plate 40 provides a finished surface upon which the dispensing wheel 32 rests. It contains an opening 44 which aligns with the opening 22 in the base 18 so as to provide a continuous drug administration channel.

Beneath intermediate plate 40 is electronics board 50. Board 50 includes the electronic circuitry employed by the device to record and react to drug delivery from the device. Board 50 carries battery 52 and integrated circuit 54. The configuration shown is merely representational and does not attempt to illustrate the components actually present. Board 50 has an opening 56 which aligns with openings 22 and 44 when device 10 is assembled.

The key element of device 10 is found on board 50. This is detector 58 which is positioned adjacent to opening 56. Detector 58 is shown as an optical detector together with I.R. emitting diode 60. When a pill or tablet passes through opening 56, it also passes between detector 58 and source 60 so as to interrupt the beam of light ("light" is used broadly to include nonvisible spectral areas such as the far infrared (I.R.) region) falling on detector 58. This causes detector 58 to give an altered electrical signal which can be used as a direct indiction of the dispensing of a drug dose to the patient.

This signal can be stored in a memory in device 10 for later reading and use by the health care professional supervising the patient's drug regimen. It can also be correlated with a particular position on the dispensing wheel 32 so as to identify the drug actually delivered if more than one drug is present in card 26.

Board 50 also carries switch 62. Switch 62 is a leaf switch which extends through notch 48 so as to be contacted by cover 14 when case 12 is closed. Switch 62 is in series with detector 58 and diode 60 so as to turn off the detector circuit whenever cover 14 is closed and to only turn on the device when the cover is open. This is completely logical since the pills 24 etc. are present in a blister pack card 26 which requires physical intervention such as finger pressure or the like to push the pill out of card 26 and through aligned openings 34, 44, 56 and 22. This cannot be done when cover 14 is closed. Thus, battery life is extended since the necessary circuit is only turned on during such times that an actual dispensing event is possible. Alternatives to switch 62, which would function equivalently, include, for example, a jiggle switch activated by the motion of the device or a switch activated by the pressure placed on the pill to push it out of the blister pack. The memory and clock circuits for recording and timing the delivery events generally require small amounts of power and thus can be left on when the case is closed. A shut off switch, such as switch 62, also prevents an inadvertent incorrect indication of drug delivery, as might occur if a small object, such as a nail file, a key, or the like were to enter the drug administration channel inadvertently and interrupt the detector space.

Figure 5:
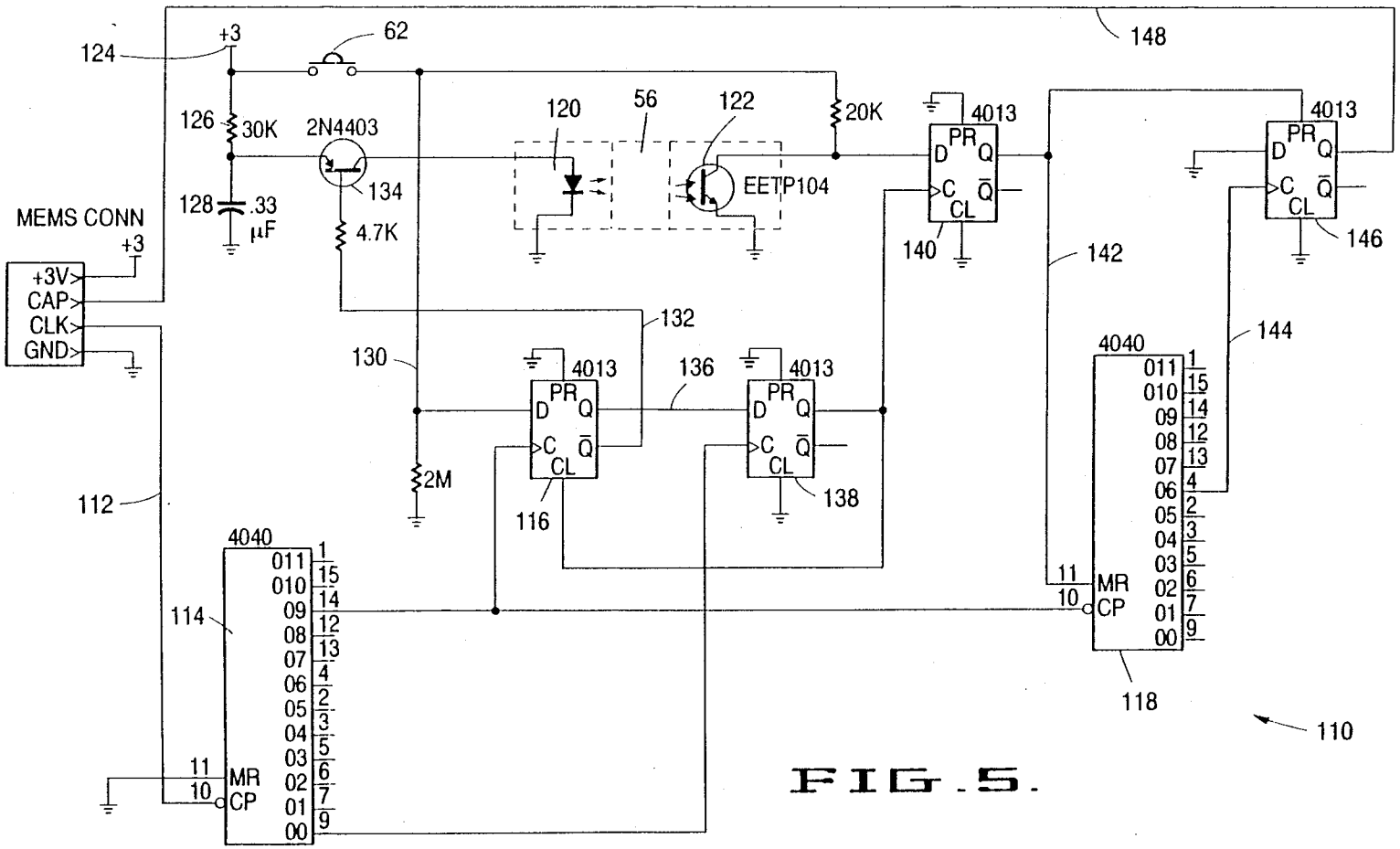
FIG. 5 is an electrical schematic illustrating one form of circuit usable for carrying out the invention.

A typical electronic circuit for use with this device is shown as circuit 110 in FIG. 5. This figure shows a circuit for a detector system in which the actual dispensing of a pill is noted. A clock signal provided by a 32 kHz crystal (not shown) is delivered via line 112 to pin CP of 14 stage counter 114, which produces a 512 Hz pulse which is fed to pin C of latch 116 and to pin CP of 14 stage counter 118. This 512 Hz signal is used to turn on and off infrared source 120 and infrared detector 122 on opposite sides of drug passage 56. This 512 Hz frequency is selected to reduce power consumption as compared to a continuously-on detector system, but is a high enough frequency to prevent a pill from passing through passage 56 without detection. The power supply for light source 120 includes voltage source 124, resistor 126 and capacitor 128. These components are selected to permit a charge adequate to fire LED 120 to build up under low battery drain conditions. This allows a low ampere-hour lithium cell to be used to power the LED and avoids the requirement for high ampere-hour power sources. When cover switch 62 is open, i.e. when the cover itself is closed, no signal is fed to latch 116 via line 130. When the cover switch is closed, a signal is sent via line 130 to pin D of latch 116. This causes a logic high signal to be sent by latch 116 via line 132 to transistor 134. This causes LED 120 to fire. LED 120 fires at the 512 Hz frequency. Latch 116 simultaneously sends a signal to latch 138 via line 136. Latch 138 sends a signal to detector 122 via latch 140 so that detector 122 pulses in synchronization with LED 120. When switch 62 is closed, so that the LED and detector are both firing, and the detector does not detect a pulse from the LED, it is assumed that a pill is traversing chamber 56. This causes latch 140 to set and send a signal to pin MR of counter 118 via line 142. Counter 118 generates a 2 second long pulse which is transmitted via line 144 to pin C of latch 146. Latch 146 thus sends a 2 second long pulse to the microprocessor via line 148. This long pulse is sent because the microprocessor may advantageously be set to only periodically, for example, once every half second or so, detect signals coming via 148. This 2 second length is long enough to assure detection by the pulsed microprocessor. The microprocessor records this pulse as an indication that a drug dose has been delivered to the patient.

If a pill were to become stuck in passage 56, and thus occlude the beam, this would normally generate a single event for detection by the microprocessor. If, however, a pill was stuck and the lid was closed and reopened, this would give rise to an indication that a second pill was taken. Latch 140 is positioned in the circuit to prevent this from occurring.

The circuit and invention set out herein may advantageously be used in conjunction with other related inventions, such as, for example, the invention of R.G. Hamilton et al. entitled "Drug Dispensing Event Detector," filed on or about even date herewith and bearing attorney docket number 050--0031. This application is incorporated herein by reference. It describes in more detail the microprocessor circuit and sets out a logic for validating drug delivery events.

The device 10 can provide additional assistance to assure proper drug delivery. When the lid is opened, thus closing switch 62, this is an indication that the patient is about to take a drug dose. The time of this "drug request" can be noted and electronically compared with a preset or preferred regimen of dosing times contained within the device's memory. The device can give guidance to the patient as to whether or not the requested dose fits properly within the preferred regimen. This guidance can be in the form of an audio signal or, as shown in FIG. 1, as a visible signal provided by lights 38, 38' and 38''. These lights (e.g., LEDs) provide signals to the patient indicating, for example, that (1) the dose is proper, (2) the dose request is outside the desired range and thus the dose should be altered or (3), the patient should consult with his or her health care professional before taking the requested dose. In FIGS. 1, 15, 15' and 15'' are explanatory labels telling what each indicator light means. The device can provide other readouts or messages to the patient, including, without limitation, the date, a reminder to purchase a renewed drug supply, etc. Similarly, the device could contain circuitry to provide a prompt to alert the patient to take medication.

In use, the patient opens the lid of container 10. Then wheel 32 is rotated to bring the next pill or other drug dosage form into alignment with the dispense aperture. Then the blister-packed pill so aligned is pressed out through the aperture. It will be appreciated, that since the drug refill card is in a particular alignment with the wheel 32, each pill contained in the refill card corresponds to a particular aperture in wheel 32. The device can include means for identifying these various apertures, such as any form of electronic or mechanical registration, and this information can be read by the device and stored in the memory in conjunction with the record of the particular pill delivery. This can be very helpful when the device includes a plurality of dosage forms. As will be further appreciated, since the device is capable of sending signals to the patient, the signals could direct the patient to particular positions on the delivery wheel so as to obtain one of several drugs, and the device could record the proper delivery of this drug in accord with the instructions.

The invention can find one mode of application in the delivery of sequential birth control pills. As can be seen with reference to FIG. 1, a disc 26 of birth control pills, varying in chemical composition as a function of the day in the user's menstrual cycle can be placed in the device 10. The user can initiate the drug delivery at the beginning of her cycle without regard to the day of the week or the like. With prior programmed or sequential birth control pills where no actual indication of drug delivery was possible or noted, the user was generally forced to begin dosing on a preset day of the week to correspond to dates physically printed on the device. The present device permits the patient to begin drug dosing on an exact day of her menstrual cycle. This permits the drug delivery to occur on exactly the right days, and thus could permit the overall dosing of drug to be reduced in some cases. It also has the advantages that the patient can take pills continuously, without any need for interruptions at the beginning of the cycle. This lessens the chance that dosing will be started incorrectly after such a drug dosing vacation.

Figure 2:
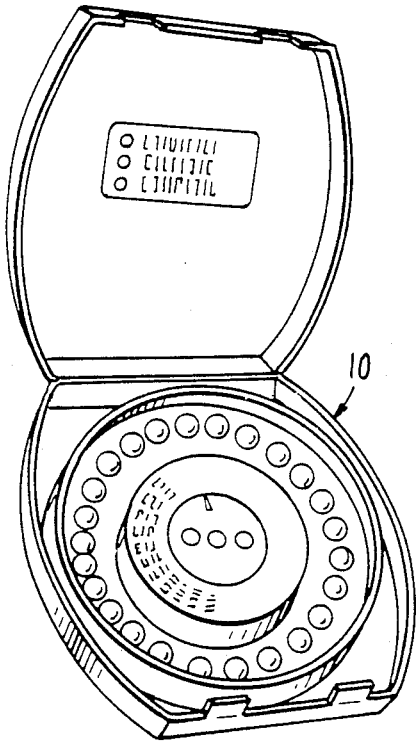
FIG. 2 is a perspective top view of the device of FIG. 1 in nonexploded form.

FIG. 2 illustrates device 10 in assembled form.

Figure 3:
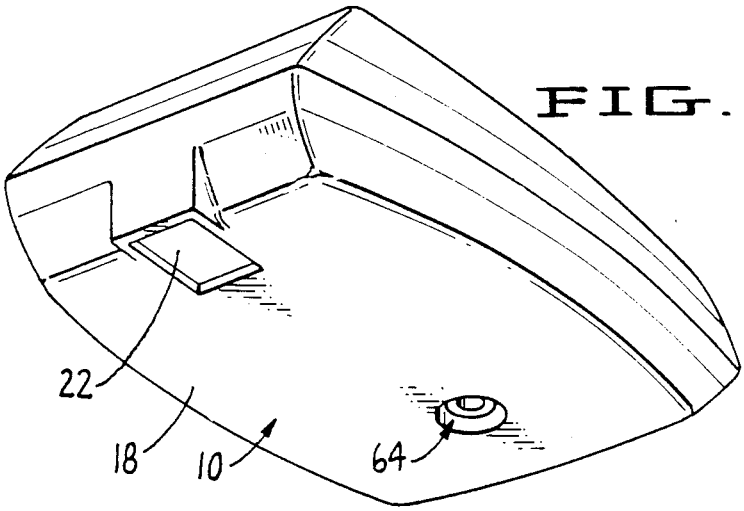
FIG. 3 is a perspective bottom view of the device of FIG. 1.

FIG. 3 illustrates a device like device 10 from an underside view so as to illustrate the drug delivery aperture 22 in base 18. In FIG. 3 an additional feature is shown as plug port 64. Data present in the memory of device 10 can be off loaded through port 64. Similarly, a new program detailing a new or revised regimen can be inputted into the microprocessor through port 64.

Figure 4:
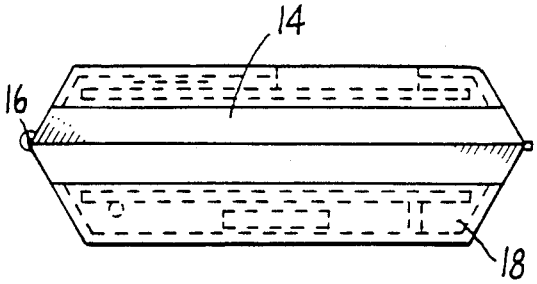
FIG. 4 is a side elevation view of the device of FIG. 1.

FIG. 4 is a side view of device 10, when closed, illustrating its small pocket-portable size.

Figure 6:
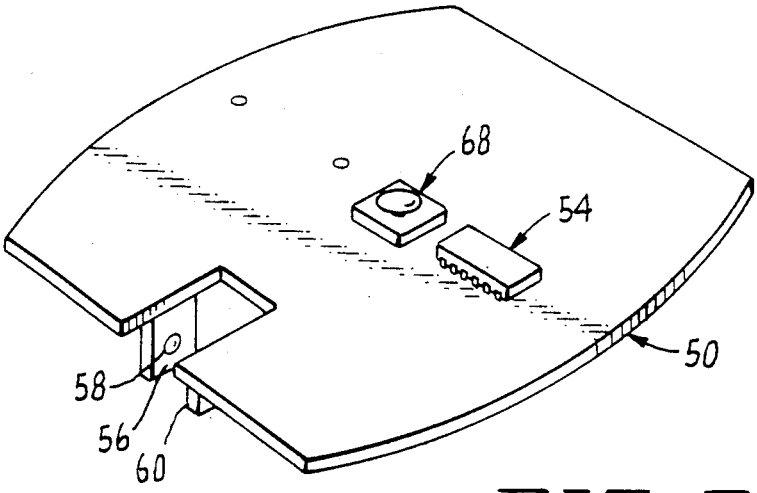
FIGS. 6 and 7 are perspective top and bottom views of the electronic board of the device of FIG. 1.
Figure 7:
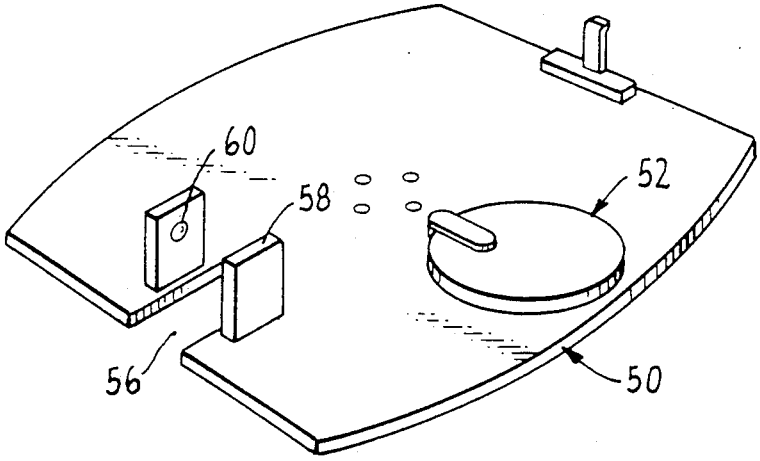

FIGS. 6 and 7 are top and bottom views, respectively, of electronics board 50, more clearly illustrating its detector made up of light source 60 and photoelectric cell 58. As shown in FIG. 6, these two elements are relatively small in size and bound to opposite sides of dispensing passage 56.

Other similarly functioning configurations for the detector can be used. These could include a combination light source/detector on one side of the passage and a reflective surface on the other. The far infrared detector and source shown in FIG. 1 is merely representative of electromagnetic radiation generating-sensing systems and could be replaced by a capacitance-measuring system which would define a region and note changes in the capacitance as a pill passes through the region. One could also use an ultrasonic measurement system to reflect waves off of a passing pill and detect the presence of the reflected waves. Similarly, one could also note the blocking of transmission of ultrasonic waves.

In any event, the detector must be positioned and calibrated to react only to the actual delivery of a dose of medication and not to respond to other events. The size of the detector and the drug passageway should be paired so that the detector operates across the entire drug passageway so as to not miss the passage of a drug dose.

Figure 8:
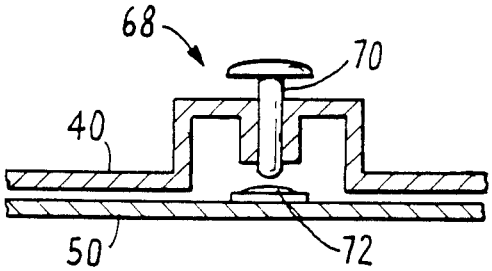
FIG. 8 is a cross sectional view of a switch useful in the device of FIG. 1.

In FIGS. 6 and 7, item 54 is the microprocessor and 52 is the battery. 68 is a switch essentially equivalent to switch 62 in device 10 but located in the center of the device so as to be activated when the top is opened. This switch 68 is shown in more detail in FIG. 8 as including a depressible plunger 70 present in intermediate plate 40 which acts on pressure switch 72 located in circuit board 50.

Figure 9:
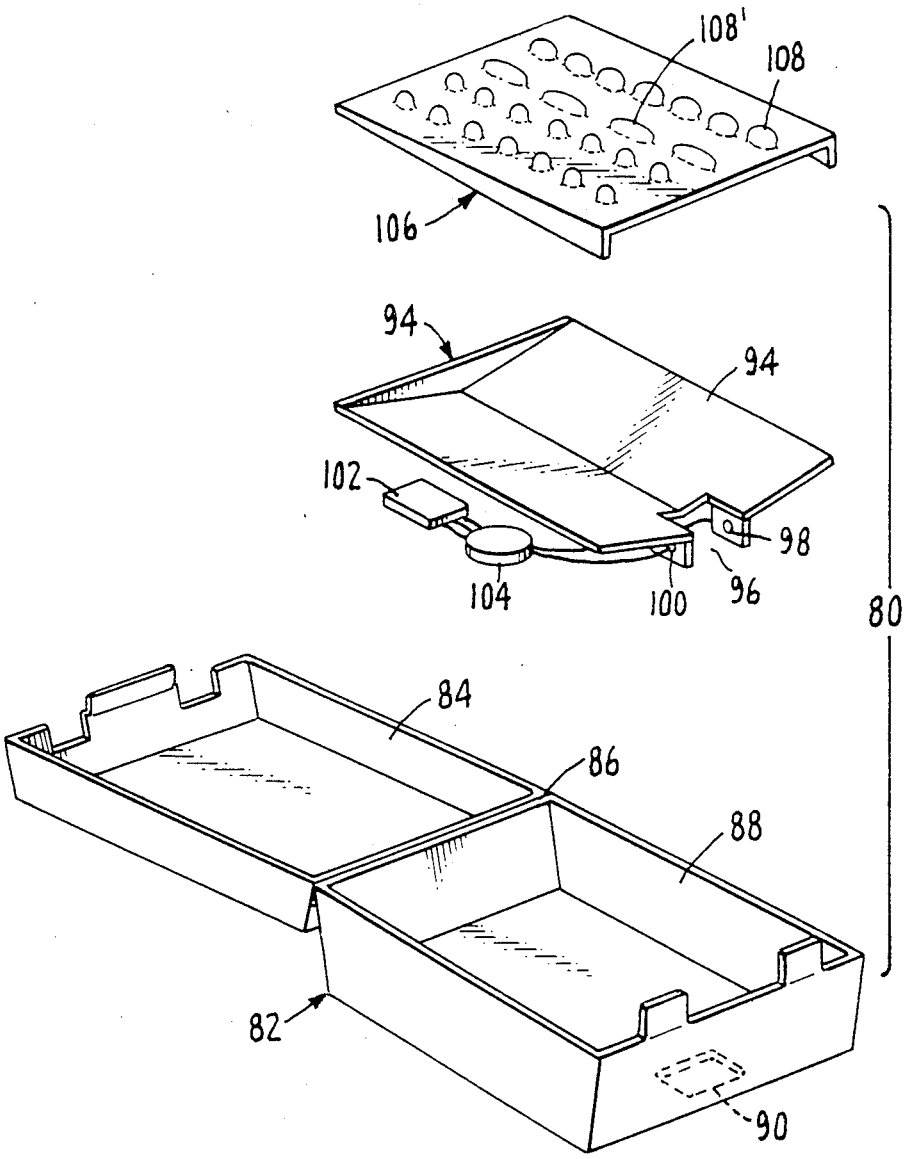
FIG. 9 is an exploded perspective view of an alternative embodiment of the device of this invention.

Another embodiment of the device of this invention is shown in FIG. 9 as device 80. Device 80 includes a pill storage container 82 which has a lid 84, attached via hinge 86 to base 88. Base 88 has a drug delivery aperture 90 through which pills or other dosage forms are delivered to the patient.

Device 80 includes a troughlike tray 92. Tray 92 has a sloped surface 94 to collect pills from a plurality of positions and pass them all to a common drug delivery passageway 96 which is equivalent to passage 56 in device 10. Passage 96 is bounded by detector 98 and I.R. source 100 to detect the passage of pills through the passageway. These detection events are noted and stored in memory 102, which is powered by battery 104.

Device 80 also includes a drug storage tray or plate 106 which contains a plurality of doses of one or more drug agents 108 and 108'. These are shown in a blister pack configuration. They, like the drugs in device 10, are released from the blister pack by finger pressure or the like. They then fall into tray 92 for passage past detector 96–100 and dispensing via aperture 90.

Device 80 has the advantage of simplicity, but has the disadvantage of not automatically identifying easily which pill or which drug is being delivered from the several drugs it contains. If this information is needed, it can be supplied by methods known in the art, such as by breaking conductive traces in the blister pack membrane by the pushing out of the pill (see, for example, U.S. Pat. Nos. 4,616,316 of Hanpeter et al. and 4,526,474 of Simon).

Figure 10:
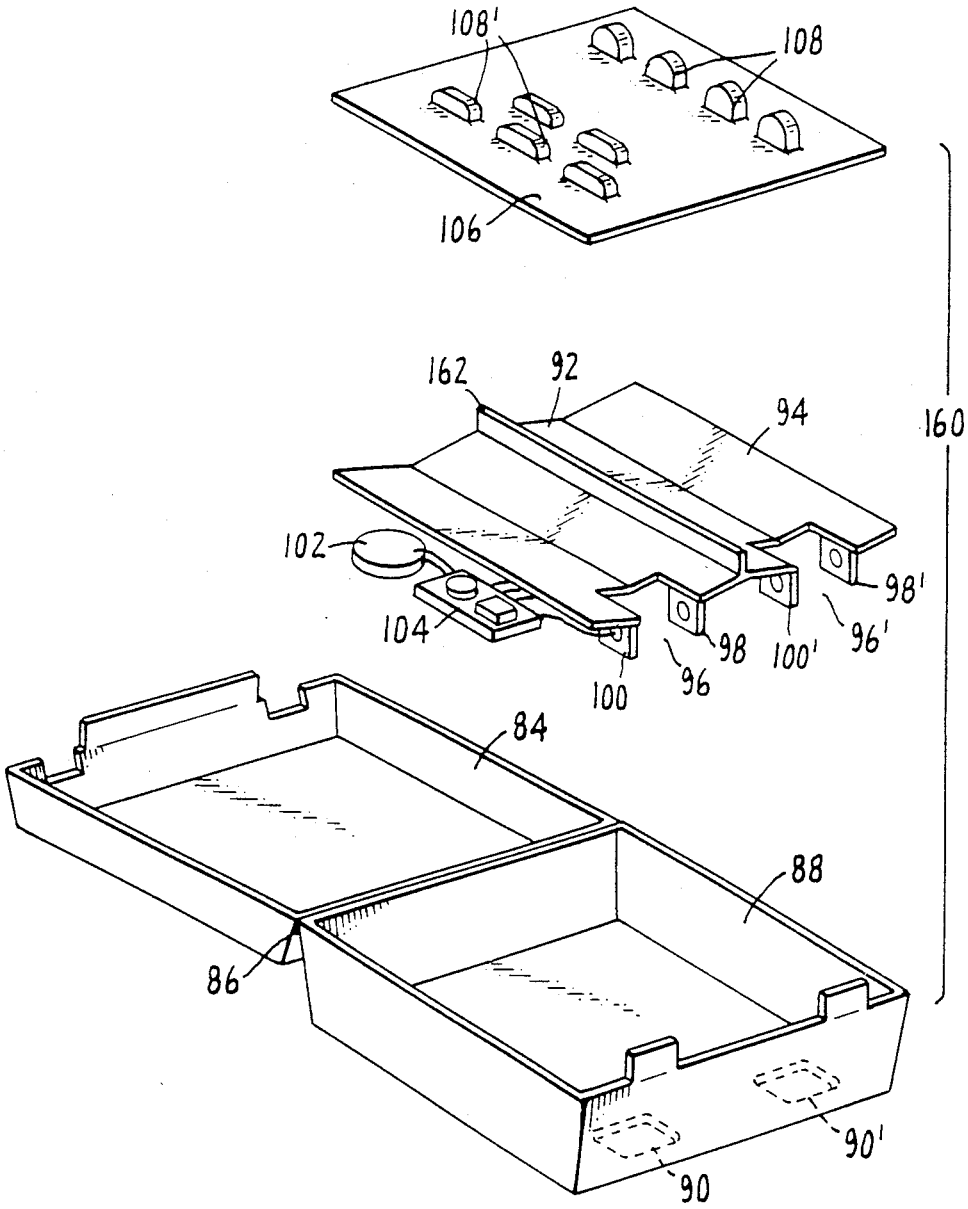
FIG. 10 is an exploded perspective view of yet another alternative embodiment of the device of this invention.

A variation of device 80 is shown as device 160 in FIG. 10. Device 160 is similar to device 80 but has the feature that it includes more than one drug (drugs 108 and 108') and has more than one dispensing opening (openings 90 and 90') with more than one source-detector set ups (96–98–100 and 96'–98'–100'). The two drugs are kept separate from one another by barrier 162. Tray 94 defines a pair of troughs which collect and channel the various drugs to the desired openings. This device makes it possible to separately keep track of the delivery of more than one drug.

The drug dosing information gathered by the present invention has great utility in permitting the health care industry to more closely monitor the positive effects of drugs based on their actual delivery rather than being confused by negative effects of drug nondelivery. The devices find application where a wide range of drugs which are administered in a prolonged regimen and can lead to lower dosing or more timely dosing with the benefits which flow therefrom.

Although the present invention has been described with reference to certain preferred embodiments, it will be appreciated that these embodiments are not limitations and that the scope of the invention is defined by the following claims.

What is claimed is:

1. A patient-portable, patient-operable device for effecting and monintoring the self-dispensing of drug to said patient comprising a drug dose storage chamber adapted to house a plurality of separate patient-dispensable doses of drug, said chamber being isolated from said patient by an openable cover and being in communication with an exit passageway, said passageway being sized to permit the passage of a separate dose of the drug therethrough from the storage chamber to the patient when dispensed by the patient but being smaller in cross section than the storage chamber, and means for electronically detecting the physical passage of a separate dose of the drug through said passageway and for generating a signal in response to said passage, said means for detecting being actuated to a state capable of detecting the passage of the dose of drug by the opening of the openable cover.

2. The device of claim 1 wherein the means for electronically detecting the physical passage of a dose of drug comprises radiation sensing means which senses a change in electromagnetic radiation as the dose of drug passes through the passageway.

3. The device of claim 2 wherein the electromagnetic radiation is light and the radiation sensing means is an optical sensor.

4. The device of claim 3 wherein the means for electronically detecting includes a light source capable of generating a beam of light which traverses the passageway and is interrupted by the dose of drug as it passes through the passageway.

5. The device of claim 2 wherein the electromagnetic radiation is infrared radiation and the radiation detecting means is an infrared sensor.

6. The device of claim 1 wherein the means for detecting the physical passage of a dose of drug comprises means for measuring the capacitance of the passageway and for detecting changes in this capacitance as the dose of drug passes through the passageway.

7. The device of claim 1 wherein the means for detecting the physical passage of a dose of drug comprises means for passing an ultrasonic beam through the passageway and measuring changes in the ultrasonic beam as the dose of drug passes through the passageway.

8. The device of claim 1 wherein the drug storage chamber in which a plurality of doses of drug is housed comprises means for containing and segregating doses of a plurality of drugs during storage and means for communicating the doses of the plurality of drugs to a single dispensing passageway.

9. The device of claim 8 wherein the means for detecting the physical presence of doses of drug in the passageway is capable of distinguishing among the plurality of different drugs from which the doses are selected.

10. The device of claim 1 wherein the drug storage chamber in which a plurality of doses of drug is housed comprises means for containing and segregating doses of a plurality of drugs during storage and means for communicating the doses of each of the plurality of drugs to separate dispensing passageways each of said passageways being equipped with means for detecting the physical passage of a drug dose therethrough.

* * * * *